US009052680B2

(12) United States Patent
Toichi

(10) Patent No.: US 9,052,680 B2
(45) Date of Patent: Jun. 9, 2015

(54) FUR BRUSH ROLLER, AND CLEANING UNIT AND IMAGE FORMING APPARATUS PROVIDED THEREWITH

(71) Applicant: KYOCERA Document Solutions Inc., Osaka (JP)

(72) Inventor: Tetsuya Toichi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/290,430

(22) Filed: May 29, 2014

(65) Prior Publication Data

US 2014/0356019 A1 Dec. 4, 2014

(30) Foreign Application Priority Data

May 31, 2013 (JP) ..... 2013-116520

(51) Int. Cl.
*G03G 21/00* (2006.01)
*G03G 15/16* (2006.01)

(52) U.S. Cl.
CPC ..... *G03G 21/0035* (2013.01); *G03G 15/161* (2013.01)

(58) Field of Classification Search
CPC ..... G03G 21/0035; G03G 15/161
See application file for complete search history.

(56) References Cited

U.S. PATENT DOCUMENTS

| | | | | |
|---|---|---|---|---|
| 5,689,791 | A * | 11/1997 | Swift | 399/353 |
| 2005/0079319 | A1* | 4/2005 | Ohara et al. | 428/96 |
| 2011/0150532 | A1 | 6/2011 | Shimura et al. | |
| 2011/0229234 | A1* | 9/2011 | Hozumi et al. | 399/357 |
| 2012/0003022 | A1* | 1/2012 | Pickering et al. | 399/354 |

FOREIGN PATENT DOCUMENTS

| | | | |
|---|---|---|---|
| DE | 10344414 | A1 * | 5/2005 |
| JP | 03-116083 | A | 5/1991 |
| JP | 04-270371 | A | 9/1992 |
| JP | 06236134 | A * | 8/1994 |

OTHER PUBLICATIONS

Machine translation of the Abstract of reference Kirchhoff et al. (DC 103 44 414 A1) , Pub Date May 4, 2005.*
Machine translation of reference Katsuno et al. (JP 06-236,134 A), Pub Date Aug. 23, 1994.*
Machine translation of the Abstract or reference Katsuno et al. (JP 06-236,134 A), Pub Date Aug. 23, 1994.*
The extended European search report mailed by European Patent Office on Oct. 15, 2014 in the corresponding European patent application No. 14170621.8—6 pages.

* cited by examiner

*Primary Examiner* — Rodney Bonnette
(74) *Attorney, Agent, or Firm* — Knobbe, Martens Olson & Bear LLP

(57) ABSTRACT

A fur brush roller electrically absorbs and removes a transferred remaining toner on a surface of an image carrier through bias voltage impression. This fur brush roller includes: a foundation cloth, conductive yarns, and insulation yarns. The insulation yarns are subjected to crimp-texturizing processing. The conductive yarns and the insulation yarns are alternately pile-woven to the foundation cloth.

10 Claims, 6 Drawing Sheets

Fig.6

| | 0 SHEETS | 100000 SHEETS | 300000 SHEETS | 600000 SHEETS |
|---|---|---|---|---|
| SA-7 | ○ | ○ | △ | △ |
| SA-7+UW | ○ | ○ | ○ | ○ |
| TPF | ○ | ○ | × | × |
| TPF+UW | ○ | ○ | ○ | ○ |

FUR BRUSH ROLLER, AND CLEANING UNIT AND IMAGE FORMING APPARATUS PROVIDED THEREWITH

INCORPORATION BY REFERENCE

This application claims priority to Japanese Patent Application No. 2013-116520 filed on 31, May, 2013, the entire contents of which are incorporated by reference herein.

BACKGROUND

This disclosure relates to a fur brush roller used in a cleaning unit of an image forming apparatus, and the cleaning unit and the image forming apparatus provided with such a fur brush roller, and more specifically to a technology of maintaining cleaning performance of the fur brush roller over its long-term use.

In an image forming apparatus having a belt-like image carrier such as an intermediate transfer belt, a toner image primarily transferred onto a photosensitive drum is transferred onto a surface of the belt-like image carrier, and is further transferred onto recording paper by a secondary transfer roller. Then the color toner image transferred onto the recording paper is fixed on the recording paper at a fixing section through thermal compression. In such an image forming apparatus, foreign substances such as a toner and paper powders may remain on the surface of the image carrier after the secondary transfer processing, and these foreign substances are removed by the cleaning unit.

Typically, the cleaning unit includes: a fur brush roller making sliding contact with the image carrier; a sweep roller or a collection roller making sliding contact with the fur brush roller; and a scraper making sliding contact with the sweep roller. The transferred remaining toner has positive or negative electric charges, and is electrically absorbed and removed from the surface of the image carrier by the fur brush roller to which a bias with polarity opposite to that of the toner is applied. The toner removed from the surface of the image carrier by the fur brush roller is collected with electrostatic force and crimping force by the sweep roller. The transferred remaining toner collected by the sweep roller is scraped off by the scraper.

For example, there is a cleaning device which, as a result of forming a brush of a fur brush roller with a mixture of conductive yarns and insulation yarns, removes foreign substances on a surface of an image carrier by applying a bias with polarity opposite to charge polarity of a transferred remaining toner to the fur brush roller and electrostatically attracting the transferred remaining toner by the conductive yarns and adhesively collecting it, and also by charging the insulation yarns through friction by the transferred remaining toner and thereby electrostatically attracting the transferred remaining toner and adhesively collecting it.

SUMMARY

As one aspect of this disclosure, a technology obtained by further improving the aforementioned technology is suggested.

A fur brush roller according to one aspect of this disclosure electrostatically absorbs and removes a transferred remaining toner on a surface of an image carrier through bias voltage impression.

The fur brush roller includes: a foundation cloth, conductive yarns, and insulation yarns.

The insulation yarns are subjected to crimp-texturizing processing.

The conductive yarns and the insulation yarns are alternately pile-woven to the foundation cloth.

Moreover, a cleaning unit according to one aspect of this disclosure has the fur brush roller described above. This cleaning unit electrically absorbs and removes a transferred remaining toner on a surface of an intermediate transfer belt.

Moreover, an image forming apparatus according to one aspect of this disclosure includes: an intermediate transfer belt, the fur brush roller described above, and the cleaning unit described above.

BRIEF DESCRIPTION OF THE DRAWINGS

FIG. 6 is a diagram graphically showing test results of cleaning performance of the four kinds of fur blush rollers.

DETAILED DESCRIPTION

Figure 1:
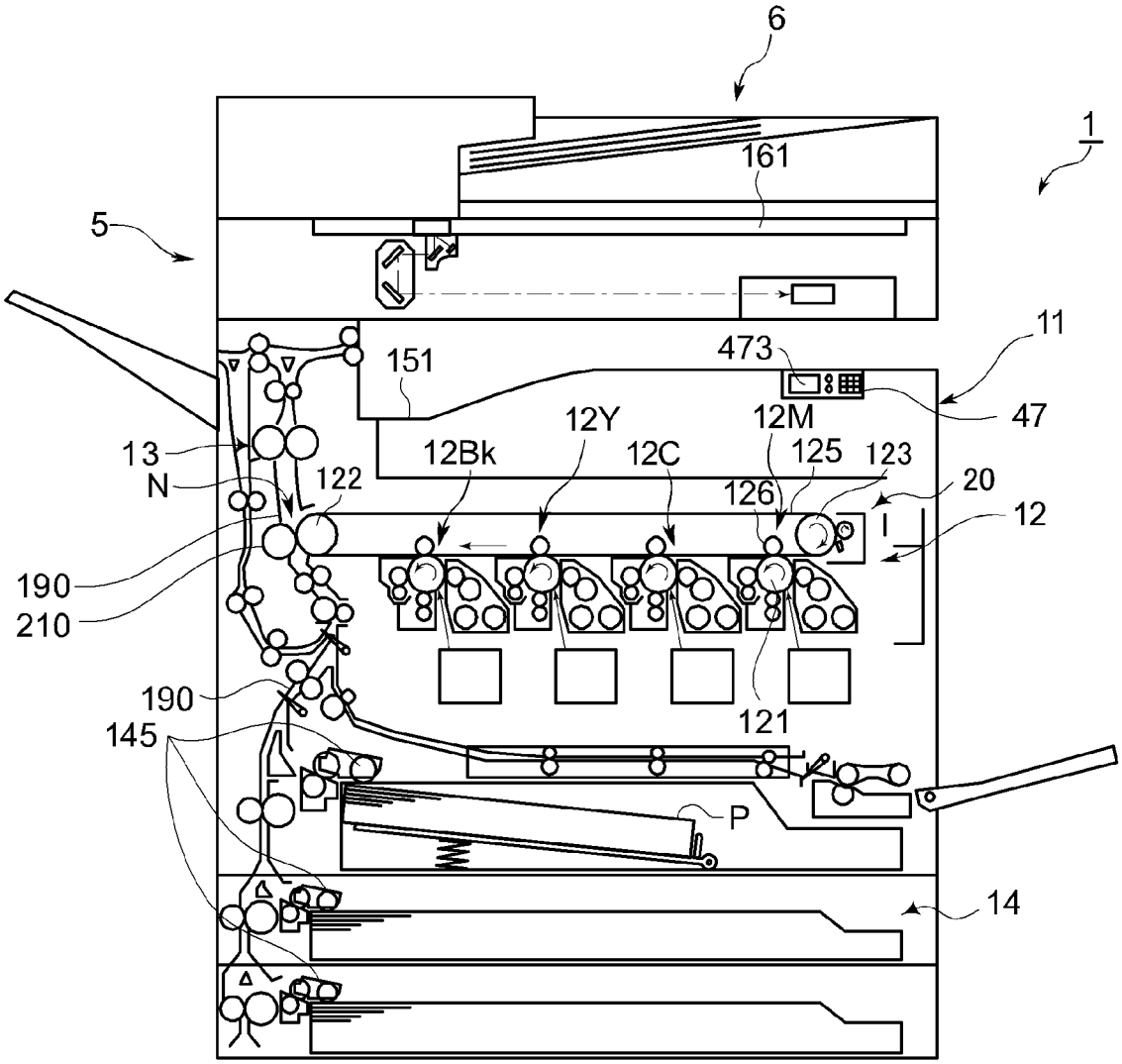
FIG. 1 is a sectional elevation view showing a structure of an image forming apparatus according to one embodiment of this disclosure.

Hereinafter, a fur blush roller and an image forming apparatus provided therewith according to one embodiment of this disclosure will be described with reference to the drawings. FIG. 1 is a sectional elevation view showing a structure of the image forming apparatus according to one embodiment of this disclosure.

The image forming apparatus 1 according to one embodiment of this disclosure is a composite machine combining a plurality of functions, for example, a copy function, a printer function, a scanner function, and a facsimile function. The image forming apparatus 1 includes: an apparatus main body 11, an operation section 47, an image formation section 12, a fixing section 13, a paper feed section 14, a document feed section 6, an image reading device 5, etc.

The operation section 47 receives, from an operator, instructions such as image formation operation execution instructions and document reading operation execution instructions for various operations and processing executable by the image forming apparatus 1. The operation section 47 includes a display section 473 displaying, for example, an operation guide for the operator.

Upon performance of the document reading operation by the main body 1, the image reading device 5 optically reads an image of a document fed by the document feed section 6 or a document loaded on a contact glass (document loading glass) 161 to thereby generate image data. The image data generated by the image reading device 5 is saved into, for example, a built-in HDD or a network-connected computer.

Upon performance of the image formation operation by the image forming apparatus 1, based on the image data generated by the document reading operation described above, image data received from a user terminal device such as the network-connected computer or a smart phone, or image data stored in the built-in HDD, the image formation section 12 forms a toner image on recording paper P as a recording medium fed from the paper feed section 14. Each of image formation units 12M, 12C, 12Y, and 12Bk of the image formation section 12 includes: a photoconductor drum; a developing device that supplies a toner to the photoconductor drum; a toner cartridge (not shown) that stores the toner; a charging device; an exposing device; and a primary transfer roller 126.

To perform color printing, the image formation unit 12M for magenta, the image formation unit 12C for cyan, the image formation unit 12Y for yellow, and the image formation unit 12Bk for black, all of which are included in the image formation section 12, based on images composed of the respective colors forming the image data, respectively form toner images on the photoconductor drum 121 through charging, exposure, and developing processes, and transfer the toner images by the primary transfer roller 126 onto an intermediate transfer belt 125 stretched over a driving roller 122 and a driven roller 123. The intermediate transfer belt 125 corresponds to an image carrier.

The intermediate transfer belt 125 has an image carrying surface, on which the toners image are to be transferred, set on its outer circumferential surface, and is driven by the driving roller 122 while abutting a circumferential surface of the photoconductor drum 121. The intermediate transfer belt 125 endlessly runs between the driving roller 122 and the driven roller 123 in synchronization with each photoconductor drum 121.

The toner images of the respective colors to be transferred onto the intermediate transfer belt 125 are superposed on one another on the intermediate transfer belt 125 through transfer timing adjustment, thereby forming a color toner image thereon. The secondary transfer roller 210, at a nip part N formed with the driving roller 122 with the intermediate transfer belt 125 in between, transfers the color toner image, which has been formed on a surface of the intermediate transfer belt 125, onto paper P conveyed from the paper feed section 14 through a conveyance path 190. Then the fixing unit 13 fixes the toner image on the paper P through thermo-compression. The paper P with the color image already formed thereon after subjected to fixing processing is discharged onto a discharge tray 151.

On a side of the driven roller 123, a cleaning unit 20 is arranged. The cleaning unit 20 removes a toner and paper powder remaining on the intermediate transfer belt 125 after secondary transfer processing at the nip part N. Details of the cleaning unit 20 will be described later on.

The paper feed section 14 includes a plurality of paper feed cassettes. A control section (not shown) drives, into rotation, a pick up roller 145 in the paper feed cassette storing recording paper of a size specified by operator's instructions, and thereby conveys the recording paper P stored on each paper feed cassette towards the nip part N.

Figure 2:
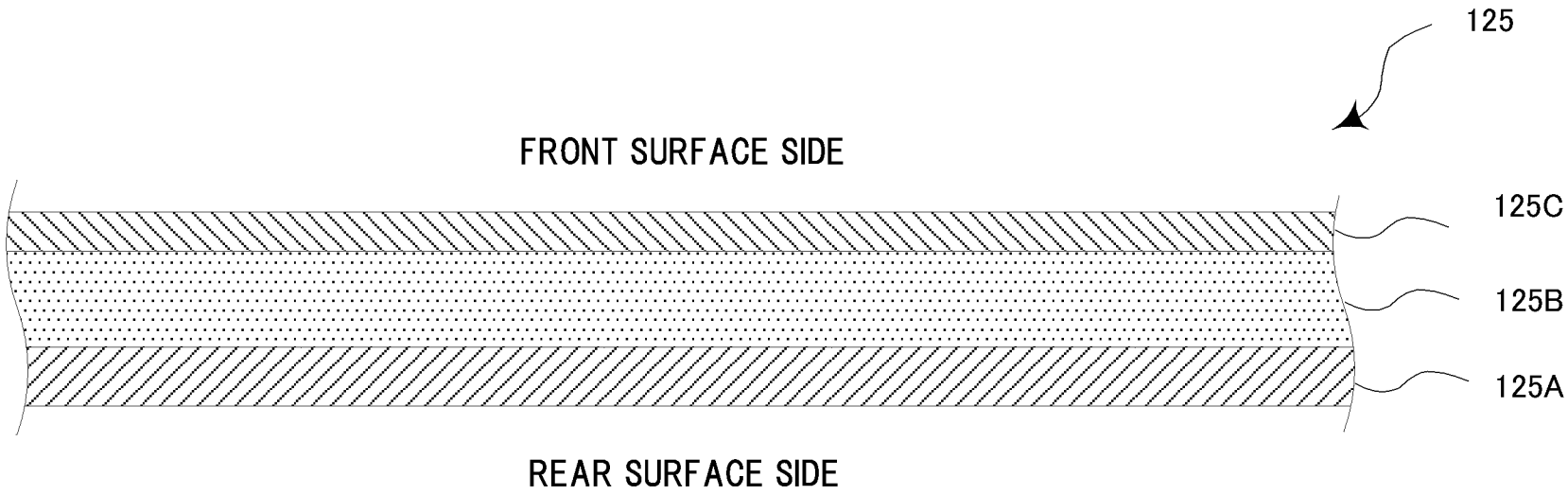
FIG. 2 is a schematic sectional view of an intermediate transfer belt.

FIG. 2 is a schematic sectional view of the intermediate transfer belt 125. The intermediate transfer belt 125 is a belt which includes elastic layer and has a reinforcement layer 125*a*, an elastic layer 125*b*, and a surface protection layer 125*c* superposed in order. The reinforcement layer 125*a* is formed on a rear surface of the intermediate transfer belt 125 and the surface protection layer 125*c* is formed on the surface of the intermediate transfer belt 125. For the reinforcement layer 125*a*, a resin film of, for example, polyimide (rigid polyimide in particular) or polyvinylidene fluoride (PVDF) is used. For the elastic layer 125*b*, for example, nitrile rubber (NBR), silicone rubber, or urethane is used. For the surface protection layer 125*c* on the belt surface, a flexible material is used for the purpose of following stretch of the elastic layer 125*b*. For example, as the surface protection layer 125*c*, for example, fluorine-based resin or Teflon (registered trade mark)-based resin is applied.

Use of the belt which includes elastic layer for the intermediate transfer belt 125 can improve image quality. On the other hand, the surface protection layer 125*c* on the belt surface is soft and thus has a drawback that an externally attached material of a toner, paper powders, etc. adhere to the belt surface in a manner such as to be pierced therethrough and the belt surface gets whitened. Progress of the whitening of the belt surface changes a resistance value of the belt surface and thus also changes charge property of the toner adhering to the belt surface, which results in a risk that the transferred remaining toner cannot be removed sufficiently. Therefore, in the image forming apparatus 1 having the intermediate transfer belt 125 as the belt which includes elastic layer as described above, for the purpose of avoiding the whitening of the belt surface, there are demands on the cleaning unit 20 for particularly high cleaning performance.

Figure 3:
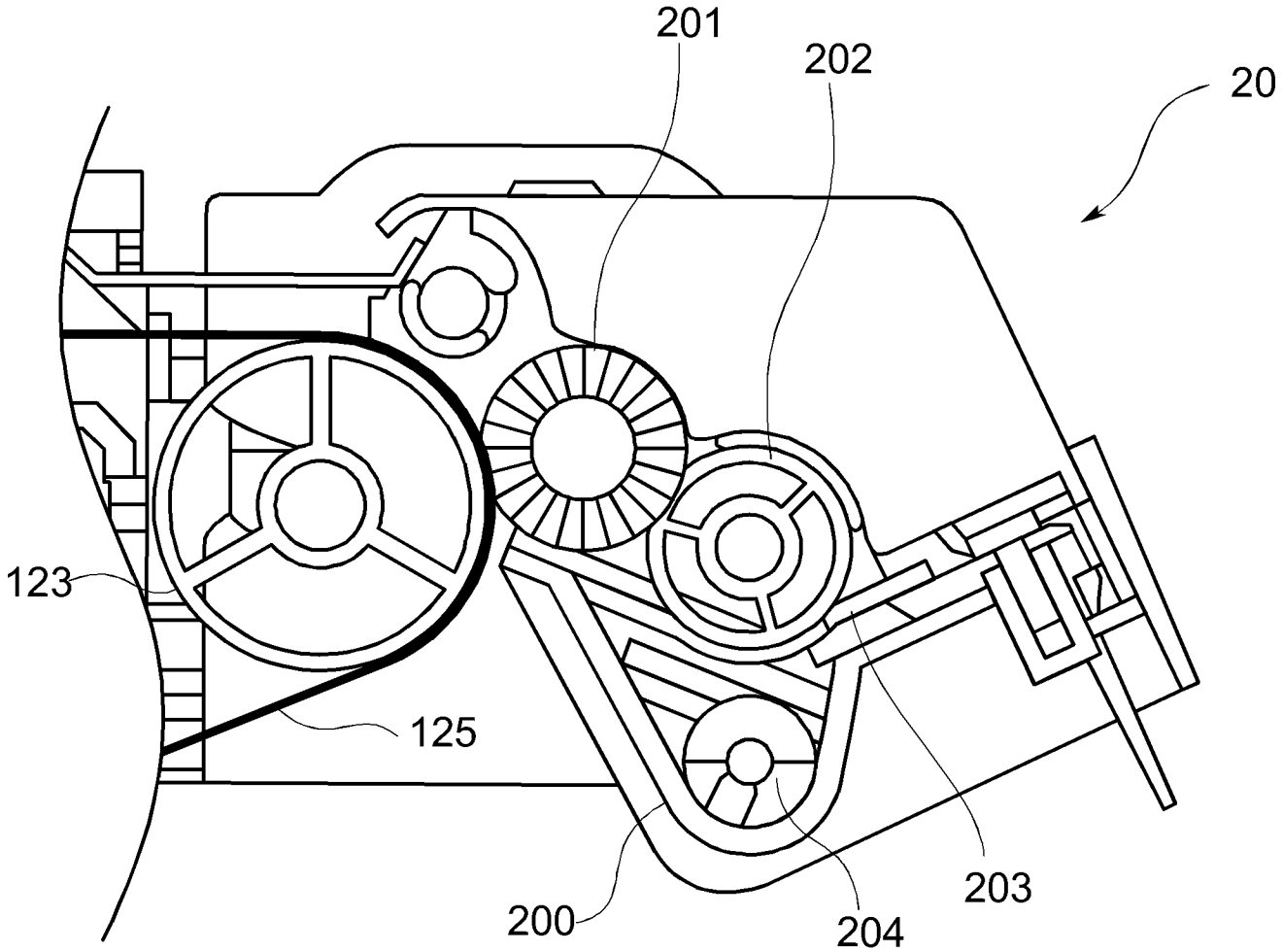
FIG. 3 is an inner side view showing schematic configuration of a cleaning unit.

Next, configuration of the cleaning unit 20 will be described. FIG. 3 is an inner side view showing schematic configuration of the cleaning unit 20.

The cleaning unit 20 extends in a width direction of the intermediate transfer belt 125. The cleaning unit 20 includes: a cleaning case 200; a fur brush roller 201 arranged oppositely to the driven roller 123 and making sliding contact with the intermediate transfer belt 125; a sweep roller 202 making sliding contact with the fur brush roller 201; a scraper 203 making sliding contact with the sweep roller 202; and a spiral 204.

The fur brush roller 201 is a roller-like fur brush, and is driven by a driving source, not shown, into rotation in a direction opposite to a direction in which the intermediate transfer belt 125 rotatably moves. Moreover, applied to the fur brush roller 201 is bias with polarity opposite to charge polarity of the transferred remaining toner on the surface of the intermediate transfer belt 125, for example, bias with negative potential. This makes it possible to electrostatically absorb and remove foreign substances such as the transferred remaining toner and paper powder remaining on the surface of the intermediate transfer belt 125.

The sweep roller 202 is driven by the same driving source as the aforementioned driving source or another driving source, not shown, into rotation in a direction opposite to a direction in which the fur brush roller 201 rotates. Moreover, applied to the sweep roller 202 is a bias with polarity opposite to that of the bias applied to the fur brush roller 201. As a result, the sweep roller 202 electrostatiscally absorbs and collects foreign substances such as the transferred remaining toner and paper powders absorbed by the fur brush roller 201

The scraper 203 abuts a surface of the sweep roller 202, and scrapes off the foreign substances such as the transferred remaining toner and the paper powder collected from the fur brush roller 201 and drops them into the cleaning case 200. The spiral 204 is driven by the same driving source as the aforementioned driving source or another driving source, not shown, into rotation, thereby finally conveying, to outside of the cleaning case 200, the transferred remaining toner, the paper powder, etc. dropped into the cleaning case 200.

The fur brush roller 201 is arranged in parallel to a rotation axis of the driven roller 123. In the fur brush roller 201, around a metallic shaft to which a predetermined bias is applied, an elastic body layer with, for example, a conductive sponge or rubber is formed. And fur brush roller 201 further has a pile yarn material spirally wounded on this elastic body layer.

Figure 4:
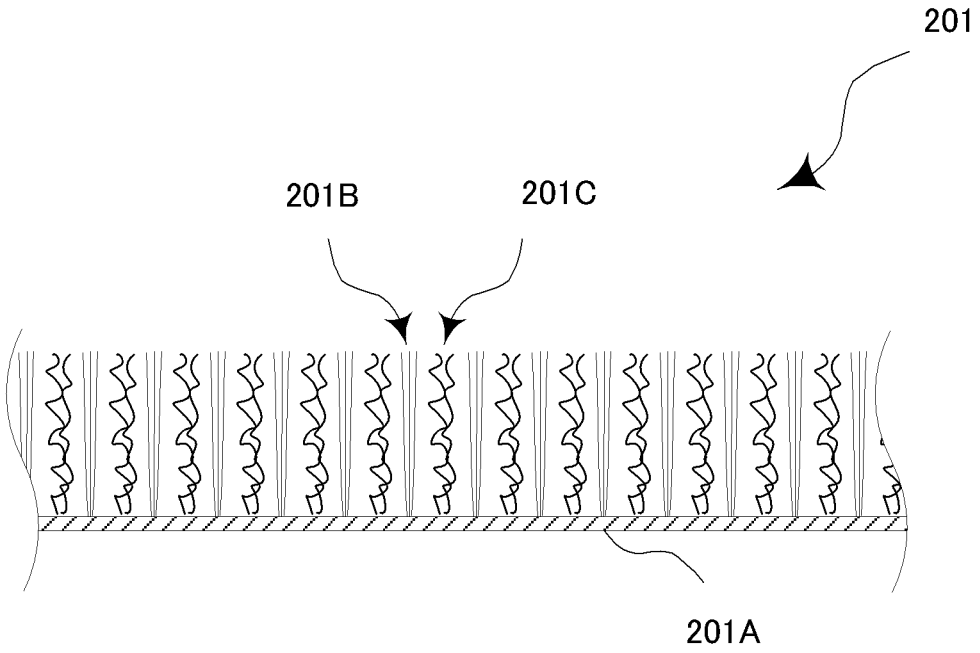
FIG. 4 is an enlarged sectional view of a pile yarn material wound around a surface of a fur blush roller.

FIG. 4 is a partially enlarged sectional view of a foundation cloth part wounded around the surface of the fur brush roller 201. Provided on the surface of the fur brush roller 201 are: the foundation cloth 201A, conductive yarns 201B, and insulation yarns 201C as the aforementioned pile yarn material. The bristle mixing of the conductive yarns 201B and the insulation yarns 201C are pile-woven to foundation cloth 201A, thus the pile yarn material is obtained. To the foundation cloth 201A, the conductive yarns and the insulation yarns are attached through pile weaving.

The foundation cloth 201A is composed of vertical yarns and horizontal yarns, not shown. For these vertical and horizontal yarns, conductive fibers are used, that is, the foundation cloth 201A has conductive property. The conductive yarns 201B and the insulation yarns 201C are interwoven as the pile yarns into these vertical and horizontal yarns in predetermined density. The conductive yarns 201B and the insulation yarns 201C are interwoven to the foundation cloth 201A alternately in a sectional view.

It is preferable that the same nap height be provided for the conductive yarns 201B and the insulation yarns 201C. This can increase the number of the conductive yarns 201B and the insulation yarns 201C as the pile yarns in contact with the surface of the intermediate transfer belt 125 and can improve cleaning performance.

Used as the conductive yarns 201B are those provided with conductive property by adding a conductive material such as carbon black to chemical synthetic fibers such as acryl or polyester.

Used as the insulation yarns 201C are those produced by use of chemical synthetic fibers such as acryl or polyester. For the insulation yeans 201C, crimp-textured yarns subjected to crimp-texturizing processing are used. The insulation yarns 201C as the crimp-textured yarns are subjected to 2000 to 3000 times of turning per 1 m for heat treatment. Normal yarns are turned 200 to 300 times per 1 m. The insulation yarns 201C are attached to the foundation cloth 201A in order to support the conductive yarns 201B.

It is desirable that the conductive yarns 201B have a wide surface area for the purpose of improving foreign substance absorption performance. For example, it is preferable that a bundle formed of ultrafine fibers be used as one conductive yarn 201B. Alternatively, as the conductive yarn 201B, one fiber divided from its middle may be used. On the other hand, for the insulation yarns 201C, those thickened more than the conductive yarns 201B through crimp-texturizing are used for the purpose of improving support performance of the conductive yarns 201B more than the absorption performance.

Long-term use of a typical fur brush roller results in falling of brush bristles due to long-term abrasion operation and frequent embracement of the transferred remaining toner and paper powders, which leads to a variation in an outer diameter. As a result, it becomes difficult for a brush tip to make contact with a surface of the image carrier, resulting in cleaning performance deterioration, which causes cleaning failure.

However, with the fur brush roller 201 configured as described above, as a result of bias voltage impression to the fur brush roller 201, the conductive yarns 201B can electrostatically absorb and remove the foreign substances such as the transferred remaining toner and the paper powders on the surface of the intermediate transfer belt 125. The insulation yarns 201C, unlike the conductive yarns 201B, have little effect of absorption force improvement by bias voltage impression, and electrostatically absorb and remove the foreign substances such as the transferred remaining toner and the paper powders on the surface of the intermediate transfer belt 125 by use of electrostatic attractive force provided by charging through friction with the transferred remaining toner. The insulation yarns 201C have poorer cleaning performance than the conductive yarns 201B, but are subjected to crimp-texturizing processing to be formed more thickly than the conductive yarns 201B and thus function as a support of the conductive yarns 201B having excellent cleaning performance.

Therefore, even under long-term use of the fur brush roller 201, brush bristles (the conductive yarns 201B and the insulation yarns 201C) of the fur brush roller 201 hardly fall, suppressing the variation in the outer diameter of the fur brush roller 201. As a result, the cleaning performance of the fur brush roller 201 can be maintained over its longer use.

Specifically, for the intermediate transfer belt 125 is an belt which includes elastic layer, and may be whitened by a lubricant and/or an additive over its long-term use. Therefore it is important to ensure the cleaning performance on the surface of the intermediate transfer belt 125 by the fur brush roller 201. With the fur brush roller 201 according to this embodiment, the brush yarns are composed of the conductive yarns 201B and the insulation yarns 201C, and with support of the conductive yarns 201B by the insulation yarns 201C, a diameter formed by the brush bristles of the fur brush roller 201 is kept over a longer period than that in a conventional case. Thus, the cleaning performance on the surface of the intermediate transfer belt 125 by the fur brush roller 201 can be ensured over a long period of time, making it possible to appropriately prevent the whitening of the surface of the intermediate transfer belt 125.

To achieve both high cleaning performance of the conductive yarns 201B and support function of the insulation yarns 201C, it is desirable that a bristle mixing ratio between the conductive yarns 201B and the insulation yarns 201C be, for example, 1:1.

Figure 5:
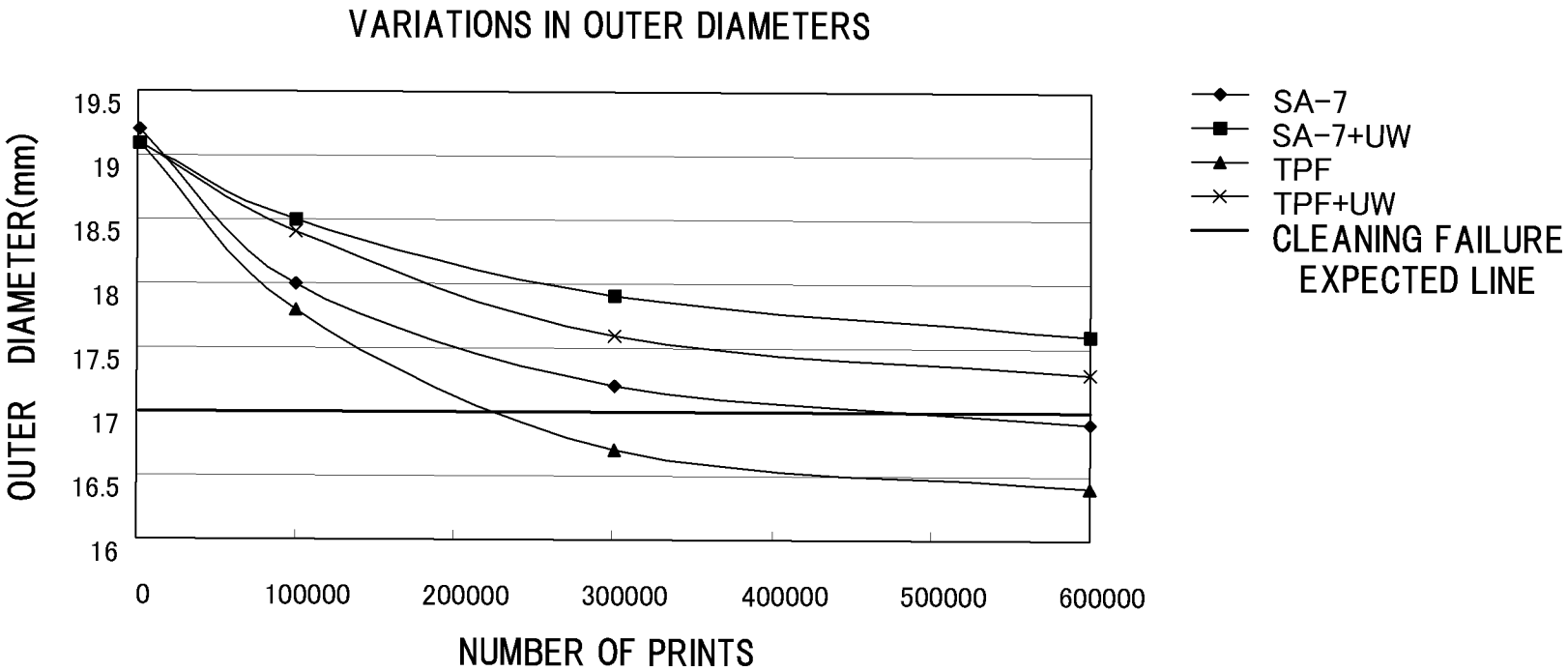
FIG. 5 is a graph showing variations in outer diameters of fur blush rollers.

<Inspection Results> Hereinafter, for fur brush rollers using four kinds of pile yarn materials containing a mixture of the conductive yarns 201B and the insulation yarns 201C as in this embodiment, variations in their outer diameters over their long-term use were tested. FIG. 5 is a graph showing the variations in the outer diameters of the fur brush rollers. In the graph, a vertical axis denotes the outer diameter of the fur brush roller and a horizontal axis denotes the number of prints. There is correlation between the number of prints and a use period, and it can be said that the use period is longer with the larger number of prints.

In the graph, "SA-7" denotes the variation in the outer diameter of the fur brush roller having only pile-woven conductive yarns formed of fibers primarily consisting of acryl. "TPF" denotes the variation in the outer diameter of the fur brush roller having only pile-woven conductive yarns formed of fibers primarily consisting of polyester. "SA-7+UW" denotes the variation in the outer diameter of the fur brush roller having a pile-woven mixture of conductive yarns formed of fibers primarily consisting of acryl and insulation yarns formed of fibers primarily consisting of polyester and subjected to crimp-texturizing processing in a bristle mixing ratio of 1:1. "TPF+UW" denotes the variation in the outer diameter of the fur brush roller having a pile-woven mixture of conductive yarns formed of fibers primarily consisting of polyester and insulation yarns formed of fibers primarily consisting of polyester and subjected to crimp-texturizing processing in a bristle mixing ratio of 1:1. The initial outer diameter of any of the fur brush rollers is 19.2 m. The outer diameters of the fur brush rollers decrease over their long-term use. A lower limit of the outer diameter with which cleaning failure is expected to occur is 17 mm.

FIG. 6 shows test results of cleaning performance of the four kinds of fur brush rollers described above. The test is performed by printing two sheets of an image with a high print rate and subsequently printing six sheets of blank paper when the numbers of prints are 0 sheets, 100000 sheets, 300000 sheets, and 600000 sheets under each of high temperature and high humidity environment and normal temperature environment. For the cleaning performance, it is evaluated whether or not a remaining image of an image pattern appears on the printed blank paper. Indicated in FIG. 6 are "×" if the remaining image of the image pattern appears on the blank paper under both of the high temperature and high humidity environment and the normal temperature environment, "Δ" if it appears only under the high temperature and high humidity environment, and "○" if it does not appear under both of the high temperature and high humidity environment and the normal temperature environment.

As can be seen from FIG. 6, as is the case with the fur brush roller 201 according to this embodiment, the fur brush rollers "SA-7+UW" and "TPF+UW" having a mixture of conductive yarns and insulation yarns subjected to crimp-texturizing processing maintain favorable cleaning performance even with an increase in the number of prints.

Moreover, as can be seen from FIG. 5, the fur brush roller "SA-7+UW" has a smaller variation in the outer diameter over its long-term use than the fur brush roller "TPF+UW" does. Therefore, it would be preferable that fibers primarily consisting of acryl be used for the conductive yarns 201B and fibers primarily consisting of polyester be used for the insulation yarns 201C.

As described above, according to this embodiment, the bristles of the fur brush can be made difficult to fall, thereby making it possible to maintain the cleaning performance of the fur brush roller 201 over its long-term use.

Note that this disclosure is not limited to the configuration of the embodiment described above but various modifications can be made. For example, in the embodiment described above, as one embodiment of an image forming apparatus according to this disclosure, a composite machine is used for the description, but this is only one example, and it may be another image forming apparatus such as an electronic device, for example, a printer, a copier, or a facsimile device.

Moreover, the configuration and the processing shown in the embodiment above by the explanation using FIG. 1-FIG. 5 are only one embodiment of this disclosure, and configuration and processing of this disclosure are not limited thereto.

Various modifications and alterations of this disclosure will be apparent to those skilled in the art without departing from the scope and spirit of this disclosure, and it should be understood that this disclosure is not limited to the illustrative embodiments set forth herein.

What is claimed is:

1. A fur brush roller electrically absorbing and removing a transferred remaining toner on a surface of an image carrier through bias voltage impression, the fur brush roller comprising:

a foundation cloth with conductive property provided on a roller surface;

conductive yarns; and insulation yarns subjected to crimp-texturizing processing, wherein the conductive yarns and the insulation yarns are alternately pile-woven to the foundation cloth.

2. The fur brush roller according to claim 1, wherein the same bristle height is provided for the conductive yarns and the insulation yarns.

3. The fur brush roller according to claim 2, wherein a bristle mixing ratio between the conductive yarns and the insulation yarns is 1:1, the insulation yarns are subjected to 2000 to 3000 times of turning per 1 m for heat treatment to be thereby formed into a shape thicker than that of the conductive yarns, and the conductive yarns are provided on a circumferential surface of the roller while being supported by the insulating yarns.

4. The fur brush roller according to claim 1, wherein a bristle mixing ratio between the conductive yarns and the insulation yarns is 1:1.

5. The fur brush roller according to claim 1, wherein the conductive yarns are formed of fibers primarily consisting of acryl, and the insulation yarns are formed of fibers primarily consisting of polyester.

6. The fur brush roller according to claim 1, wherein the insulation yarns are subjected to 2000 to 3000 times of turning per 1 m for heat treatment to be thereby formed into a shape thicker than that of the conductive yarns.

7. The fur brush roller according to claim 6, wherein the conductive yarns are provided on a circumferential surface of the roller while being supported by the insulation yarns.

8. A cleaning unit having the fur brush roller according to claim 1, and electrically absorbing and removing a transferred remaining toner on a surface of an intermediate transfer belt.

9. An image forming apparatus comprising:

an intermediate transfer belt; and a cleaning unit having the fur brush roller according to claim 1 and electrically absorbing and removing a transferred remaining toner on a surface of the intermediate transfer belt.

10. The image forming apparatus according to claim 9, wherein the intermediate transfer belt is a belt with a multi-layered structure having: a resin-made reinforcement layer; an elastic layer superposed on a top surface of the reinforcement layer; and a surface protection layer superposed on a top surface of the elastic layer.

* * * * *